United States Patent [19]

Schnell

[11] Patent Number: 4,485,711

[45] Date of Patent: Dec. 4, 1984

[54] ADJUSTABLE STRADDLE BLOCK

[75] Inventor: John W. Schnell, Columbia, Mo.

[73] Assignee: Shopsmith, Inc., Dayton, Ohio

[21] Appl. No.: 414,146

[22] Filed: Sep. 2, 1982

[51] Int. Cl.[3] ..... B26D 7/06

[52] U.S. Cl. ..... 83/425; 83/437; 83/438; 83/477.2

[58] Field of Search ..... 83/477.2, 438, 437, 83/435.1, 425

[56] References Cited

U.S. PATENT DOCUMENTS

| | | | |
|---|---|---|---|
| 2,410,467 | 11/1946 | Valentine | 83/437 |
| 2,522,965 | 9/1950 | Schaufelberger | 83/435.1 |
| 2,754,857 | 7/1956 | Joslin | 83/478 |
| 4,348,925 | 9/1982 | Manweiler | 83/435.1 |
| 4,370,909 | 2/1983 | Jennings | 83/435.1 |

*Primary Examiner*—James M. Meister

*Assistant Examiner*—J. L. Knoble

*Attorney, Agent, or Firm*—Biebel, French & Nauman

[57] ABSTRACT

A straddle block is used with a table saw having a rip fence, and consists of a body having a substantially vertically extending fixed leg, a bridge extending from the fixed leg, an adjustable leg attached to and vertically displaceable relative to the bridge. The vertically adjustable leg may be reversed for right or left-handed use, and has opposing, substantially horizontal, rectilinear edges for engaging an upper surface of a piece of stock to be cut on the table saw, and opposing outwardly extending step portions adjacent an end of each rectilinear edge for engaging the trailing end of the stock as it is pushed across the saw table. The bridge spaces the fixed leg from the adjustable leg sufficiently to receive a rip fence therebetween such that the straddle block may slidably engage the rip fence without skewing relative thereto.

3 Claims, 5 Drawing Figures

ADJUSTABLE STRADDLE BLOCK

BACKGROUND OF THE INVENTION

1. Field of the Invention

The present invention relates to table saw accessories and, more particularly, to accessories for feeding stock across a saw blade.

2. Prior Art

A table saw typically consists of a substantially flat, horizontally oriented saw table having a centrally located blade slot through which a circular, motor-driven saw blade protrudes. For ripping operations; that is, cutting wood stock along the grain which typically requires cutting the stock along a longitudinal dimension, a rip fence is used to guide the stock parallel to the saw blade.

A rip fence typically consists of an elongated metal bar having a substantially flat guide face which is oriented vertically with respect to the surface of the saw table and faces the saw blade. The rip fence also includes means such as clamps for securing the fence to the saw table so that the guide surface may be maintained parallel to the saw blade and blade slot in the saw table.

To perform a ripping operation, the rip fence is first aligned parallel to the saw blade and clamped to the table at the desired distance. The motor is actuated to rotate the saw blade, and the stock is fed across the table so that the longitudinal edge slides against the guide face of the rip fence and the desired cut is made. During this operation, it is necessary for the operator to lightly urge the stock against the guide face of the fence to prevent the stock from drifting away from the guide face.

If the distance between the guide face of the rip fence and the saw blade is on the order of four inches or less, the use of a push stick or other stock feeding mechanism is recommended. A push stick is an oblong length of wood or other material having a handle at one end and having a notched cutout at an opposite end. The stick is held by the operator and the notched end is positioned to engage the squared trailing end of the stock. During the aforementioned ripping operation, the stick is pushed forward by the operator, and the notched end urges the stock across the blade. The operator must use his other hand to urge the stock against the guide face.

Another type of push stick is known as a "pusher-hold-down" and comprises a length of wood or other material having a substantially flat lower surface and a pair of handles projecting upwardly from an upper surface. At the rear of the lower surface, a block is mounted to extend downwardly so that the block forms a corner with the flat lower surface and provides a vertical surface for engaging a trailing end of stock. The pusher-hold-down has an advantage over the previously described push stick in that it provides both a long surface which overlays the upper surface of the stock and a surface for engaging a trailing end of the stock so that the stock may be held down and urged forward during the ripping operation. The pusher-hold-down is also useful in grooving and in some edge-rabbeting, jointing and shaping operations which require the stock to be held down during the cutting operation.

A third type of stock feeding mechanism is known as a "fence straddler" and consists of a body having a pair of opposing, substantially vertical legs, one of which has its leading edge sloped downwardly and rearwardly, and a bridge joining the vertical legs to form a channel shape. A handle projects upwardly from the bridge and is inclined rearwardly from it. The vertical legs are spaced apart sufficiently to permit the straddler to "straddle" the rip fence with the bridge resting upon an upper surface of the rip fence.

During the ripping operation, the straddler is positioned rearwardly of the stock so that the sloped leading edge of the vertical leg adjacent the guide face abuts the trailing end of the stock and pushes the stock ahead of it across the blade as the straddler is urged forwardly. An advantage of the fence straddler is that the hand of the operator pushing the straddler is kept at a lateral distance from the rotating saw blade greater than with the previously mentioned push sticks.

Disadvantages of the existing fence straddler are that it lacks a surface to engage the top surface of the stock and hold it down against the surface of the saw table, and it is not adapted for either right handed or only left-handed use.

Accordingly, there is a need for a stock feeding device of the fence straddler-type which provides positive engagement with both the upper surface and trailing edge of the stock being cut within a range of stock thicknesses, and which is adaptable for both right and left-handed use.

SUMMARY OF THE INVENTION

The present invention consists of an adjustable straddle block which is used with a a rip fence and includes a vertically adjustable leg which is shaped to engage the upper surface of the stock as well as the trailing edge of the stock being ripped for a wide range of stock thicknesses. The adjustable straddle block of the present invention is adjustable without tools to either right-handed or left-handed use; that is, the same straddle block may be used whether the rip fence is on the right or left side of the saw blade on the saw table.

Additionally, the straddle block is relatively easy to fabricate and is simple to adjust, yet provides means for both feeding stock across a rotating saw blade and for holding the stock downwardly against the surface of the saw table; an advantage useful not only in ripping operations but for other operations such as grooving, edge-rabbeting, jointing and shaping.

The adjustable straddle block of the present invention is used with a saw table having a rip fence and includes a body having a substantially vertically extending fixed leg, a bridge extending from said fixed leg for slidably engaging a top surface of said rip fence, and an adjustable leg attached to and vertically displaceable relative to said bridge; the adjustable leg having a lower surface including a substantially rectilinear edge and a step portion extending downwardly below the edge adjacent an end. The rectilinear edge of the adjustable leg serves to hold the stock down against the saw table, while the step portion has a vertical contact edge to engage the trailing end of the stock. The adjustable leg can be displaced relative to the bridge so that the bridge rests upon and slidably engages the rip fence, while the edge of the adjustable leg rests upon the upper surface of the stock, for a wide range of stock thicknesses.

In a preferred embodiment of the invention, the adjustable leg of the body includes at least one vertically extending slot, and the body includes an adjusting bolt which engages the slot so that the bolt may be tightened to fix the adjustable leg relative to the bridge and the fixed leg, or loosened to permit slidable displacement of the adjustable leg relative to the bridge and the fixed leg. The bolt preferably includes a shank extending through the slot and the bridge and has a threaded end protruding from the bridge and a head opposite the threaded end which slidably engages the slot. A knob is threaded onto the threaded end of the shank and, when tightened down against the bridge, draws the head toward the bridge and fixed leg, thereby clamping the adjustable leg to the bridge and preventing relative movement therebetween.

The straddle block also includes a handle which preferably extends upwardly from the bridge and is elongate in shape, extending the length of the body. It is also preferable to have the handle offset with respect to the center of the bridge away from the adjustable leg so that the hand of the operator grasping the handle is positioned over the side of the fence facing away from the saw blade.

In order to prevent the skewing of the adjustable leg relative to the body, the preferred embodiment of the straddle block includes raised guides which extend vertically along an inboard surface of the adjustable leg and are oriented parallel to the vertical slot. The bridge of the body defines notches which are spaced and sized to receive slidably the guides so that vertical displacement of the adjustable leg causes the guides to slide within the notches.

It is also preferable to form the adjustable leg to include an opposing rectilinear edge and step portion on an upper surface thereof. By providing opposing edges and step portions, the adjustable straddle block may be adjusted for right-handed or left-handed use. To change the straddle block from one hand to an opposite hand, the adjusting bolt is loosened and the adjustable leg is rotated 180°, thereby moving the opposing edge and step portion into an operative, downwardly facing position, but locating the step portion at an opposite end of the straddle block. The bolt is tightened again and the straddle block used with a rip fence on an opposite side of the saw blade. To provide for this change in orientation, the vertical slot preferably is centrally located along the length of the adjustable leg, and the raised guides and notches positioned symmetrically with respect to the vertical slot.

Accordingly, it is an object of the present invention to orovide an adjustable straddle block which slidably engages a rip fence on a table saw and provides both a rectilinear edge which engages the upper surface of the stock and a step portion which engages the trailing end of the stock so that the stock may be urged downwardly and forwardly during a ripping or other cutting operation; which includes a vertically adjustable leg so that the straddle block may accommodate stock of varying thicknesses; which has a handle inclined away from the cutting area; and which may be adjusted without tools to reverse the hand of the straddle block to accommodate both right and left-handed use.

Other objects and advantages of the invention will be apparent from the following description, the accompanying drawings and the appended claims.

DESCRIPTION OF THE PREFERRED EMBODIMENT

Figure 1:
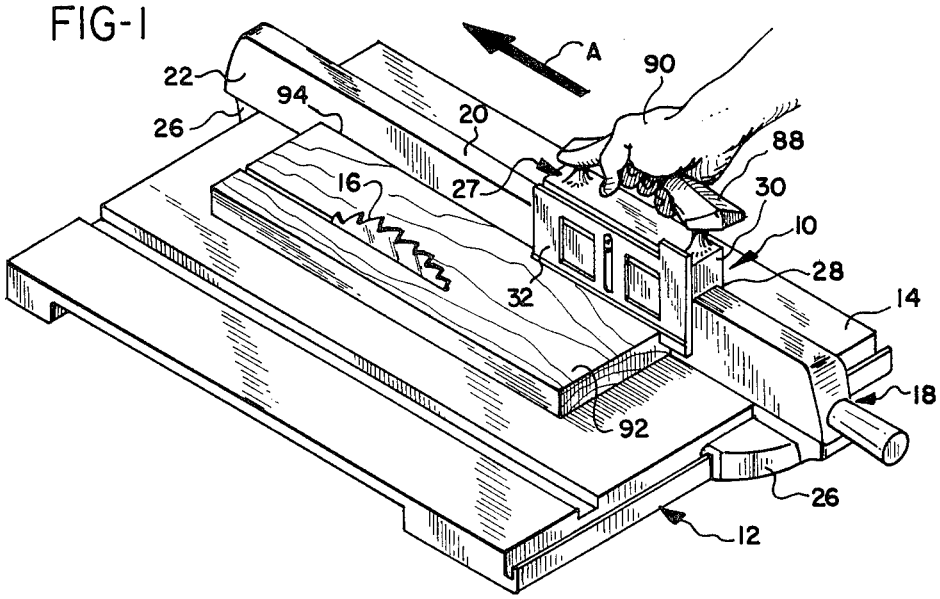
FIG. 1 is a perspective view of a preferred embodiment of the adjustable straddle block, shown mounted on a rip fence of a table saw.

As shown in FIG. 1, the adjustable straddle block of the preferred embodiment, generally designated 10, is used in combination with a table saw 12 having a saw table 14 through which protrudes a motor-driven circular saw blade 16. The table saw 12 also includes a rip fence 18 which extends along a longitudinal dimension of the saw table 14 and is aligned to be parallel to the saw blade 16. The rip fence 18 is generally elongate in shape and includes a top surface 20, guide face 22, and outboard face 24 (best shown in FIG. 3). The rip fence 18 is secured to the saw table 14 by well-known means such as clamps 26.

Figure 2:
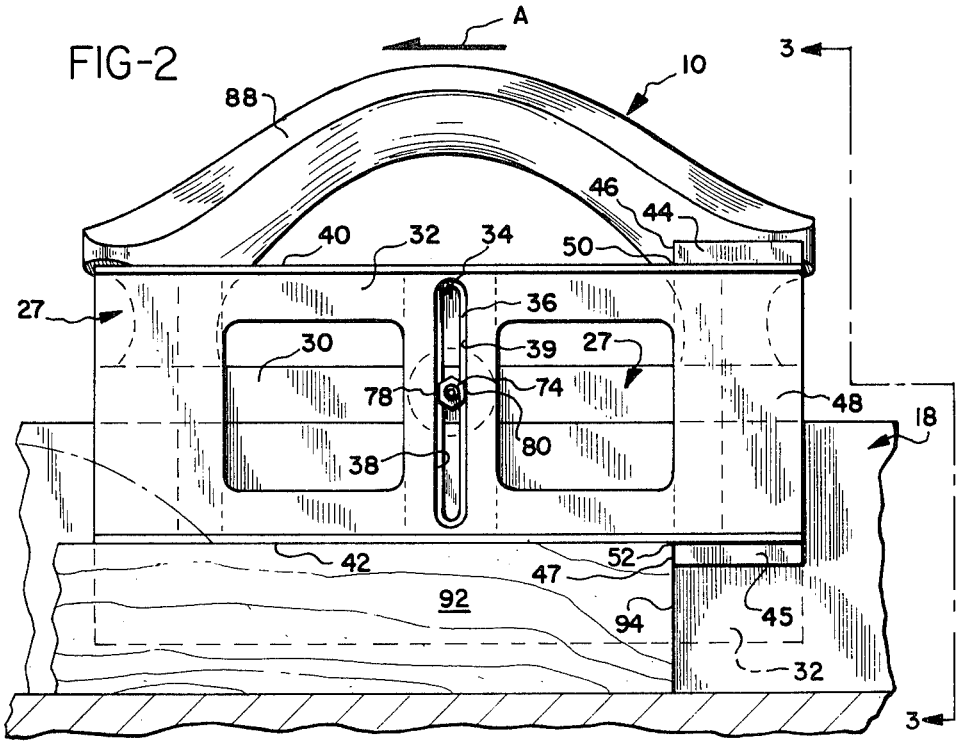
FIG. 2 is a side elevation of the straddle block shown in FIG. 1.
Figure 3:
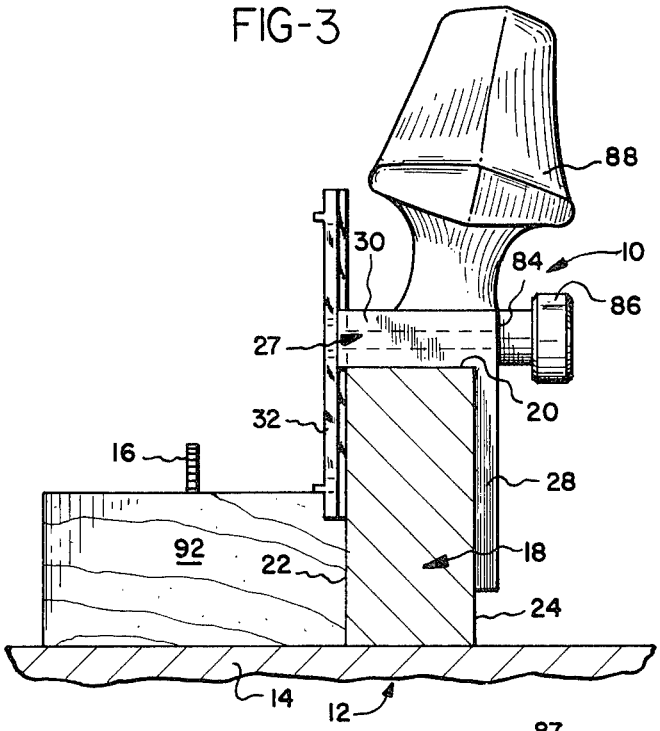
FIG. 3 is an end elevation of the straddle block, taken at line 3—3 of FIG. 2.

As shown in FIGS. 1, 2, and 3, the straddle block 10 includes a body 27 made up of a generally plate-shaped fixed leg 28, a bridge 30 which extends outwardly from an upper end of the fixed leg, and an adjustable leg 32. The bridge 30 is plate-shaped, having a substantially flat underside and a width substantially equal to that of the top surface 20.

The adjustable leg 32 has a vertically extending slot 34 located at its mid-length. The slot includes a recess 36 having opposing walls 38,39. The adjustable leg 32 also includes upper and lower surfaces having opposing rectilinear edges 40,42 oriented parallel to each other and extending substantially the length of the adjustable leg. Upper and lower opposing step portions 44,45 are positioned at a trailing end 48 of the adjustable leg. The upper and lower step portions 44,45 include contact edges 46,47 which intersect the rectilinear edges 40,42, respectively, to form corners 50,52, respectively.

Figure 4:
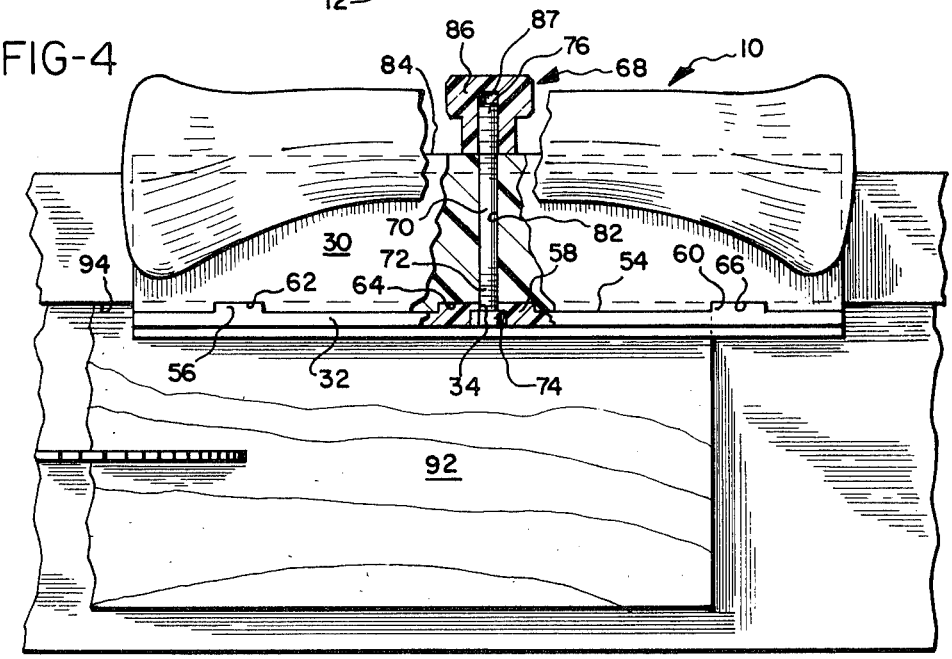
FIG. 4 is a plan view of the straddle block shown in FIG. 1 in which the handle and bridge are broken away to show the adjusting bolt.

As shown in FIG. 4, the inboard face 54 of the adjustable leg 32 is provided with vertically extending guide ribs 56,58,60 which slidably engage notches 62,64,66 formed in the bridge 30. Guide ribs 56 and 60 are symmetric with respect to the slot 34; that is, they are spaced equidistant from it. Guide rib 60 is located directly opposite the slot 34 and also is symmetric with respect to it.

The adjustable leg 32 is clamped to the bridge 30 by an adjusting bolt member 68 which includes a bolt 70 having a shank 72 which terminates in a hex head 74 at one end and has a threaded opposite end 76. As shown in FIG. 2, the hex head 74 is sized such that it may be positioned within the recess 36 of the slot 34 so that opposing faces 78,80 of the hex head slidably engage the opposing walls 38,39 of the recess, respectively.

The bolt 70 passes through a bore 82 extending transversely through the bridge 30 and is sufficiently long that the threaded end 76 protrudes outwardly from the outboard face 84 of the bridge (FIG. 4). An adjustment knob 86 receives the threaded end 76 of the bolt 70 within a threaded recess 87.

Thus, rotation of the knob 86 to tighten the straddle block 10 draws the end 76 into the recess 87, and the bridge 30 and adjustable leg 32 are clamped together between the hex head 74 and knob. Rotation of the knob 87 to loosen the block 10 releases the clamping force and permits the adjustable leg 32 to slide relative to the bridge 30 and bolt 70.

As shown in FIGS. 2 and 3, the adjustable straddle block 10 includes a handle 88 having a generally arcuate shape and extending upwardly from the bridge 30 and spanning the length of the body 27. The handle is sized to be grasped by the hand 90 of an operator (FIG. 1) and, as shown in FIG. 3, is offset away from the adjustable leg 32.

In a ripping operation, first the rip fence 18 is secured to the saw table 14 the desired distance from the saw blade 16. Wood stock 92 is placed on the saw table 14 so that a longitudinal edge 94 abuts the guide face 22 of the rip fence 18.

The straddle block 10 is placed upon the rip fence 18 so that the substantially flat underside of the bridge 30 is above the top surface 20 of the rip fence. The adjustable leg 32 overlay portion of the guide face 22 of the rip fence 18 and the fixed leg 28 overlays a portion of the outboard face 24 of the rip fence 18. The knob 86 is rotated to loosen the adjustable leg 32 from the bridge 30, permitting the adjustable leg to slide in a vertical plane with respect to the bridge and fixed leg 28.

The body 27 is lowered onto the fence 18 so that the adjustable leg 32 is displaced relative to the bridge 30 as it contacts the piece of stock 92 placed beneath it, as shown in FIG. 2. The lower rectilinear edge 42 engages the upper surface of the stock, and the corner 52 and contact edge 74 of the lower step portion 46 engage a trailing end 94 of the stock when the underside of the bridge 30 contacts the top surface 20. The knob 86 is then rotated to clamp the adjustable leg 32 against the bridge 30 to prevent movement of the vertical leg relative to the bridge 30 and, in a vertical direction, relative to the rip fence 18. Since the bridge 30 is substantially the same width as the top surface 20, the block 10 cannot skew relative to the fence 18 when mounted thereon.

The table saw 12 may now be actuated and the wood stock 92 fed to the saw blade 16 by movement of the straddle block 10 in the direction of the arrow A in FIGS. 1 and 2. It should be noted that, as the stock 92 encounters the blade 16, it is necessary for the operator to use his other hand (not shown) to urge the stock lightly against the guide face 22 of the rip fence 18 in order to prevent the stock from drifting away from the guide face. The stock is held down against the surface of the saw table 14 by the lower rectilinear edge 42 and is urged forward by the engagement of the contact edge 47 with the trailing end 94 of the stock.

Since the handle 88 is offset away from the vertical leg 32 of the straddle block 10, the hand 90 of the operator grasping the handle is maintained at a location above the fixed leg 28 of the straddle block and the outboard face 24 of the rip fence 18 away from the saw blade 16.

Figure 5:
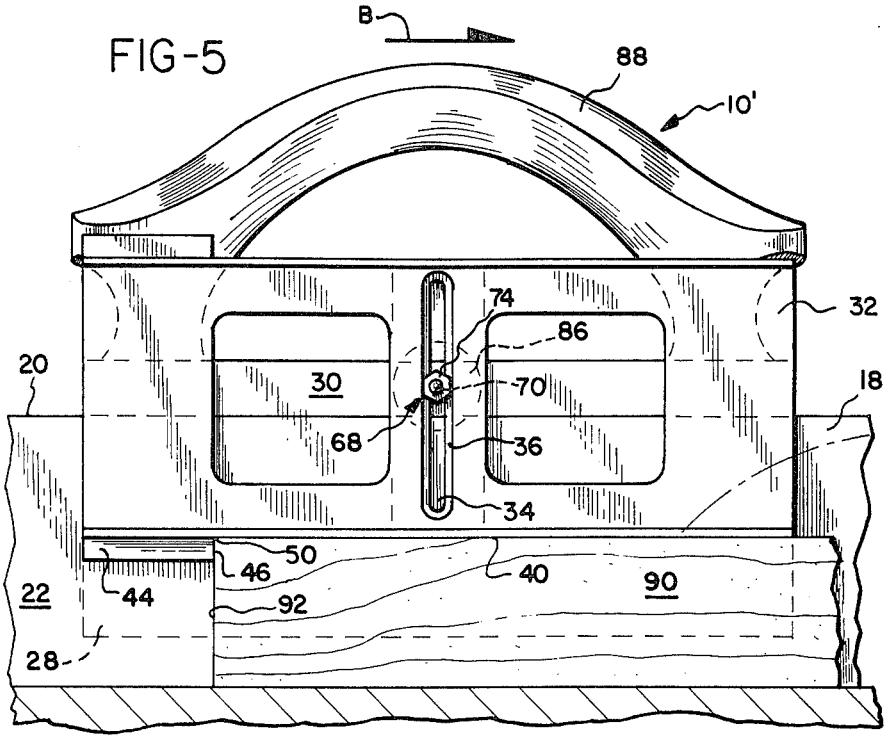
FIG. 5 is a side elevation of the adjustable straddle block of FIG. 1 in which the adjustable leg has been reversed to change the straddle block from right to left-handed use.

As shown in FIG. 5, the straddle block 10′ may be adjusted for left-handed use without use of tools or requiring additional parts. To modify the straddle block 10′ for left-handed use, the knob 86 is rotated to loosen the bolt 70, thereby releasing the adjustable leg 32 from its fixed position and interengagement with the bridge 30. The adjustable leg is then rotated 180° such that the upper rectilinear edge 40 and upper step portion 44 are brought into operative position; that is, the upper rectilinear edge and step portion face downwardly to engage the stock 92. It is also necessary to ensure that the guide rib 60 properly engages the notch 62 and the guide rib 56 engages the notch 66, the opposite of that shown in FIG. 2.

The straddle block 10′ is then placed upon the rip fence 18 (which has been positioned on a side of the saw blade 16 opposite that shown in FIG. 1) so that the bridge 30 is above the top surface 20. As before, the adjustable leg 32 will contact the guide face 22 of the rip fence 18 and the fixed leg 28 preferably will contact the outboard face 24 (shown in FIG. 3) of the rip fence 18. The adjustable leg 32 is displaced upwardly relative to the bridge 30 until the bridge rests upon the upper surface 20 and the rectilinear edge 40 rests upon the upper surface of the stock 90. The block 10′ is moved in the direction of the arrow B until the contact edge 46 and step portion 44 engage the trailing end 94 of the stock 92. The cutting procedure then proceeds in the aforementioned manner, except that the operator grasps the handle 88 with his left hand.

It should be noted that the straddle block 10 of the present invention is useful not only during ripping operations, but in other operations such as grooving (using a dado blade), edge-rabbeting, jointing and shaping. The straddle block 10 may also be used in those situations when a rip fence is utilized in combination with a jig saw or band saw.

The adjustable straddle block of the present invention may be made from a variety of materials such as wood, metal or plastic. A preferred material is polystryene due to its low cost and ease of fabrication. The adjusting bolt preferably is made of steel.

While the form of apparatus herein described constitutes a preferred embodiment of the invention, it is to be understood that the invention is not limited to this precise form of apparatus, and that changes may be made therein without departing from the scope of the invention.

What is claimed is:

1. For use with a saw table having a rip fence mounted thereto, a straddle block comprising:

a body having a substantially vertical fixed leg, an adjustable leg parallel to said fixed leg, and a bridge attached to said fixed leg and extending to said adjustable leg;

said vertically adjustable leg having upper and lower surfaces including substantially horizontal rectilinear opposing edges, and opposing step portions extending outwardly from said rectilinear edges, said step portions each including a contact edge suitable for engaging a trailing end of a piece of stock, and said adjustable leg having a centrally located vertically extending slot;

said body including guide means positioned symmetrically with respect to said slot for preventing skewing of said adjustable leg relative to said bridge;

adjusting bolt means having a shank extending through said body, a head slidably engaging said slot and means for selectively tightening said shank to clamp said adjustable leg to said bridge and loosening said shank to permit adjustment of said adjustable leg relative to said bridge, including adjustment of said block to reverse hand by rotating said adjustable leg 180° in a vertical plane; and handle means extending upwardly from said body and offset away from said adjustable leg.

2. For use with a saw table having a rip fence mounted thereon, a straddle block comprising:

a body having a substantially vertically extending fixed leg, an adjustable leg substantially parallel to said fixed leg, and a bridge extending between said fixed leg and said adjustable leg;

said adjustable leg being vertically displaceable relative to said bridge and having opposing upper and lower surfaces, each including a substantially rectilinear edge and a downwardly extending step portion adjacent an end for engaging an upper surface and trailing end, respectively of a piece of stock, such that said straddle block may be adjusted to reverse hand by rotating said adjustable leg 180° in a vertical plane;

said adjustable leg includes at least one vertically extending slot and said body includes adjusting bolt means having a shank extending through said slot and said bridge and having a threaded end protruding from said fixed leg and a head opposite said threaded end slidably engaging said slot and means threaded into said threaded end for tightening said bolt means whereby said adjustable leg is clamped to said bridge between said head and said tightening means, or loosened to permit slidable displacement of said adjustable leg relative to said bridge and said fixed leg;

said bridge spacing said fixed leg from said adjustable leg sufficiently to receive a rip fence therebetween;

handle means attached to and extending upwardly from said body, said handle means offset away from said adjustable leg toward said fixed leg; and guide means for preventing said adjustable leg from skewing with respect to said bridge and said fixed leg.

3. The straddle block of claim 11 wherein said vertical slot is centrally located on said adjustable leg and said guide means are located symmetrically about said slot.

* * * * *

UNITED STATES PATENT AND TRADEMARK OFFICE

CERTIFICATE OF CORRECTION

PATENT NO. : 4,485,711

DATED : December 4, 1984

INVENTOR(S) : John W. Schnell

It is certified that error appears in the above-identified patent and that said Letters Patent is hereby corrected as shown below:

Column 3, line 47, "orovide" should be --provide--.

Column 8, line 15, (claim 3), "11" should be --2--.

Signed and Sealed this

*Twenty-fifth* Day of *June 1985*

[SEAL]

*Attest:*

DONALD J. QUIGG

*Attesting Officer*

*Acting Commissioner of Patents and Trademarks*